US008807370B2

(12) United States Patent
Lee

(10) Patent No.: US 8,807,370 B2
(45) Date of Patent: Aug. 19, 2014

(54) PRESERVATION CONTAINER

(75) Inventor: Jin Woo Lee, Yongin-si (KR)

(73) Assignee: Dongyang Chemical Co., Ltd. (KR)

( * ) Notice: Subject to any disclaimer, the term of this patent is extended or adjusted under 35 U.S.C. 154(b) by 25 days.

(21) Appl. No.: 13/574,288

(22) PCT Filed: Jan. 28, 2011

(86) PCT No.: PCT/KR2011/000599
§ 371 (c)(1),
(2), (4) Date: Jul. 20, 2012

(87) PCT Pub. No.: WO2011/096674
PCT Pub. Date: Aug. 11, 2011

(65) Prior Publication Data

US 2012/0285958 A1 Nov. 15, 2012

(30) Foreign Application Priority Data

Feb. 2, 2010 (KR) ..... 10-2010-0009596

(51) Int. Cl.
*B65D 53/00* (2006.01)
*B65D 45/32* (2006.01)

(52) U.S. Cl.
CPC ..... *B65D 45/327* (2013.01)
USPC ..... 220/238; 220/235; 220/378

(58) Field of Classification Search
USPC ..... 220/233, 234, 235, 237, 238, 378
See application file for complete search history.

(56) References Cited

U.S. PATENT DOCUMENTS 287,189 A * 10/1883 Stone ..... 220/238
701,117 A * 5/1902 Wintherlich ..... 215/359
2,016,224 A * 10/1935 Bukolt ..... 220/295
2,462,445 A * 2/1949 Weiss ..... 215/262
2,753,074 A * 7/1956 Schmid ..... 220/235
2,966,276 A * 12/1960 Hing ..... 215/270
4,083,468 A * 4/1978 Batchelor ..... 220/234
4,316,550 A * 2/1982 de Winter ..... 215/360
4,401,228 A * 8/1983 Baldelli ..... 220/235
7,204,383 B2 * 4/2007 Hsu ..... 220/238
D596,455 S * 7/2009 Laib ..... D7/392.1
8,186,527 B2 * 5/2012 Liu ..... 215/317
2004/0245251 A1 * 12/2004 Heng et al. ..... 220/234
2005/0051558 A1 3/2005 Hagano et al.
2007/0241107 A1 * 10/2007 Matsumoto et al. ..... 220/238

FOREIGN PATENT DOCUMENTS

JP 2000300445 10/2000
KR 100790549 12/2007
KR 1020080112335 12/2008

OTHER PUBLICATIONS

International Search Report—PCT/KR2011/000599 dated Oct. 4, 2011.

* cited by examiner

*Primary Examiner* — Fenn Mathew
*Assistant Examiner* — Christopher McKinley
(74) *Attorney, Agent, or Firm* — Cantor Colburn LLP

(57) ABSTRACT

Disclosed herein is a preservation container having a container body and a lid assembly. The lid assembly includes an upper cover, a knob provided on a top of the upper cover and rotated by a user, a vertical moving unit coupled to the upper cover and moved up and down by a rotation of the knob, an intermediate cover detachably coupled to a bottom of the upper cover and having in a central portion thereof a hole through which the vertical moving unit is exposed to an outside, a lower cover coupled to the vertical moving unit, and a packing fitted into a groove which is formed in a top of the lower cover and sliding along a bottom of the intermediate cover to be in close contact with an inner surface of the container body, when the vertical moving unit moves up.

2 Claims, 6 Drawing Sheets

PRESERVATION CONTAINER

TECHNICAL FIELD

The present invention relates to a preservation container including a lid assembly and a container body that holds food or the like.

BACKGROUND ART

Generally, a preservation container such as a food container uses a hermetic sealing cover or lid which seals the container so as to maintain the quality and freshness of food held in the container.

Such a preservation container is disclosed in Korean Patent Laid-Open Publication No. 10-2008-0112335. The preservation container is constructed to be opened or closed by alternately pushing a button, and is problematic in that it is complicated in construction and it is difficult to completely disassemble the container.

Another preservation container is disclosed in US Patent Publication No. 2005/0279746 A1. The preservation container is constructed to be sealed or released by turning a knob, and is problematic in that the opening or closing operation is not reliable.

DISCLOSURE OF INVENTION

Technical Problem

Accordingly, the present invention has been made keeping in mind the above problems occurring in the prior art, and an object of the present invention is to provide a preservation container, which allows the container to be easily sealed by turning a knob of a lid assembly, and which may be completely disassembled, thus making it easy to clean the interior of the container.

Solution to Problem

In order to accomplish the above object, the present invention provides a preservation container having a container body and a lid assembly which is detachably coupled to a top of the container body. The lid assembly includes an upper cover, a knob provided on a top of the upper cover and rotated by a user, a vertical moving unit coupled to the upper cover and moved up and down by a rotation of the knob, an intermediate cover detachably coupled to a bottom of the upper cover and having in a central portion thereof a hole through which the vertical moving unit is exposed to an outside, a lower cover coupled to the vertical moving unit, and a packing fitted into a groove which is formed in a top of the lower cover and sliding along a bottom of the intermediate cover to be in close contact with an inner surface of the container body, when the vertical moving unit moves up.

The preservation container includes a bottom plate having an insert hole in a central portion of the top of the upper cover, with the vertical moving unit being inserted into the insert hole, a first wall formed to be perpendicular to the bottom plate, first and second holes circumferentially formed on opposite sides of an upper end of the first wall, an auxiliary member mounted on a top of the bottom plate, with a hole being formed in a central portion of the auxiliary member, an inclined surface formed on an upper portion of the auxiliary member, first and second protrusions connected to the inclined surface in such a way as to be perpendicular thereto, a recess formed on an outer surface of each of the first and second protrusions, lugs projected from a bottom of the knob to be inserted into the first and second holes, respectively, a locking step provided on an inner or outer surface of each of the lugs, a cylinder provided on a central portion of the bottom of the knob, third and fourth protrusions formed on an inner wall of the cylinder, a pin horizontally inserted into a hole of the vertical moving unit, a spring fitted over the vertical moving unit in such a way as to be in contact with the bottom of the upper cover, a disc provided on a central portion of the lower cover, a second wall formed to be perpendicular to the disc, with a threaded part being formed on an inner surface of the second wall, and the container body coupled to a lower end of the lower cover and having on an inner surface thereof a groove into which the packing is inserted, whereby, when the knob is turned clockwise, the pin moves up along the inclined surface, so that the spring is compressed and simultaneously the vertical moving unit is moved up, thereby sealing the container body, and when the knob is turned counterclockwise, the pin moves down along the inclined surface, so that an elastic force of the spring is restored and simultaneously the vertical moving unit is moved down, thereby releasing a sealing of the container body.

The vertical moving unit may include a base having a threaded part, a column protruding from a central portion of a top of the base and having a third hole, and fifth and sixth protrusions provided on opposite sides of the top of the base, and the lower cover may include a first stopper provided on an outer surface of the second wall, and a second stopper provided on an upper end of the second wall, whereby, when the vertical moving unit is coupled to the disc, each of the fifth and sixth protrusions moves up along the first stopper and is stopped by the second stopper.

Advantageous Effects of Invention

A preservation container according to the present invention is advantageous in that the container may be easily sealed by turning a knob of a lid assembly clockwise, and the sealing of the container may be released by turning the knob counterclockwise, so that it is easy to seal and break the seal, and parts of the container may be disassembled from each other, so that it is easy to clean the interior of the container.

MODE FOR THE INVENTION

Figure 1:
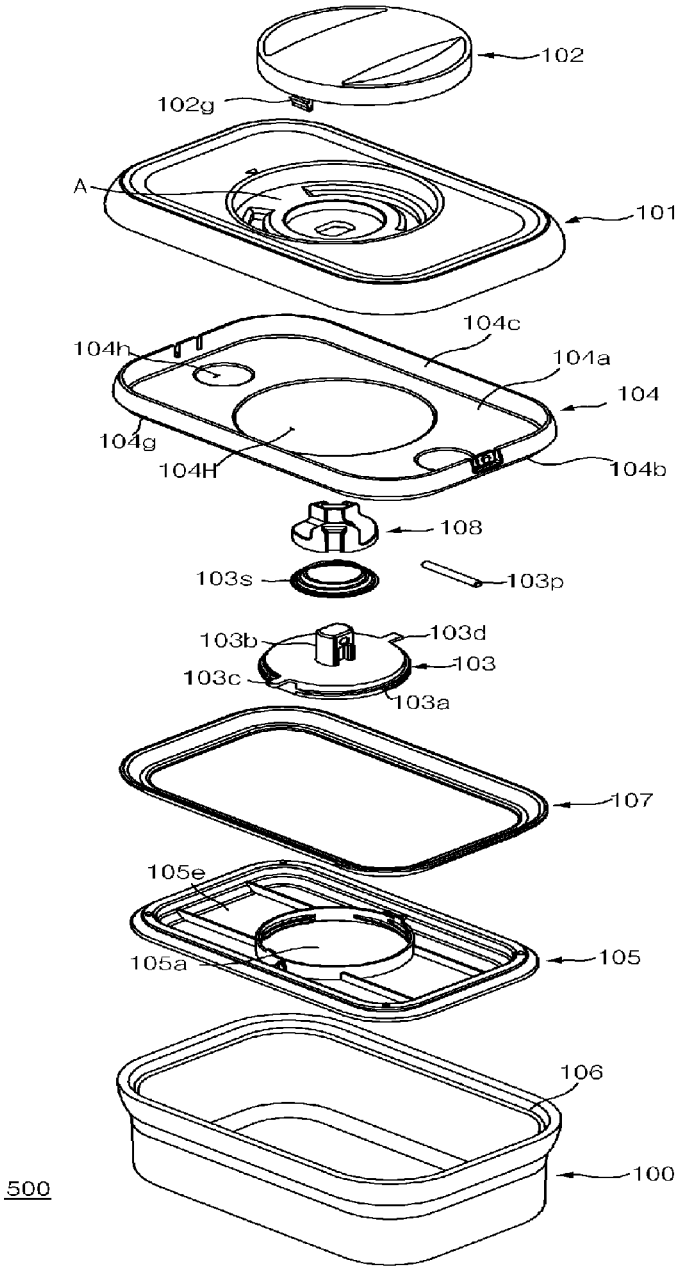
FIG. 1 is an exploded perspective view showing a preservation container according to a preferred embodiment of the present invention.
Figure 2:
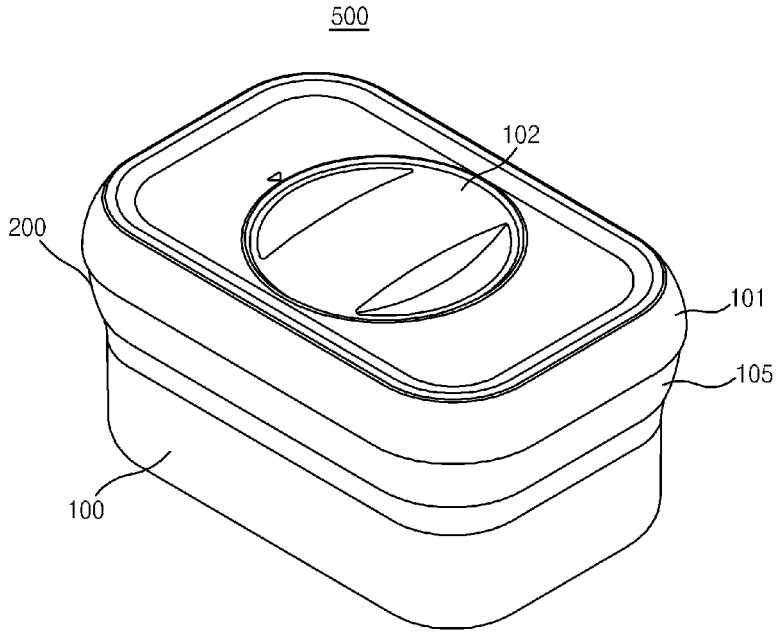
FIG. 2 is a perspective view showing the preservation container according to the preferred embodiment of the present invention.
Figure 3A:
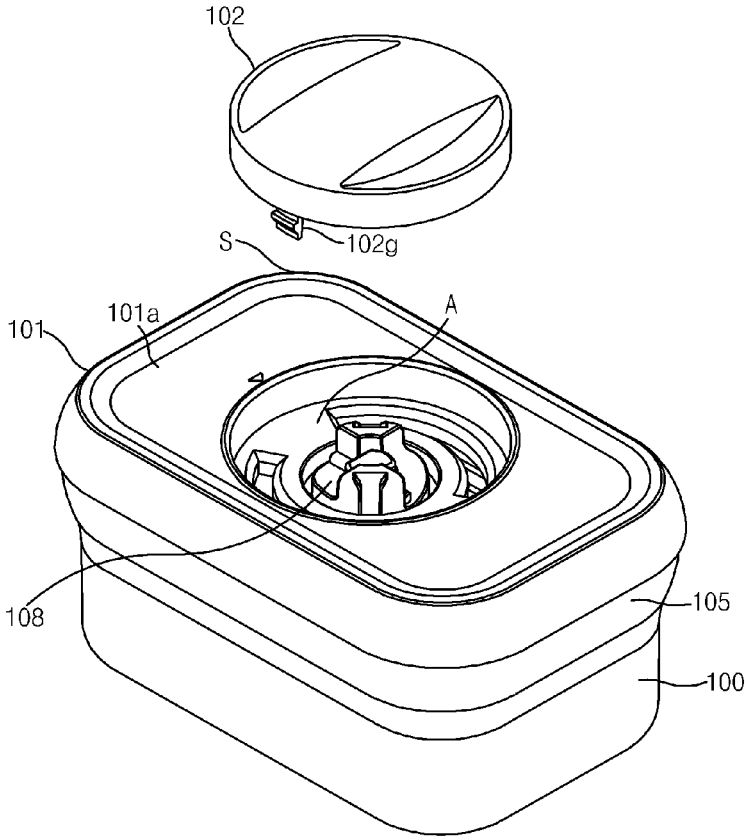
FIG. 3*a* is a perspective view showing the interior of the preservation container according to the preferred embodiment of the present invention, by separating a knob from the container.
Figure 3B:
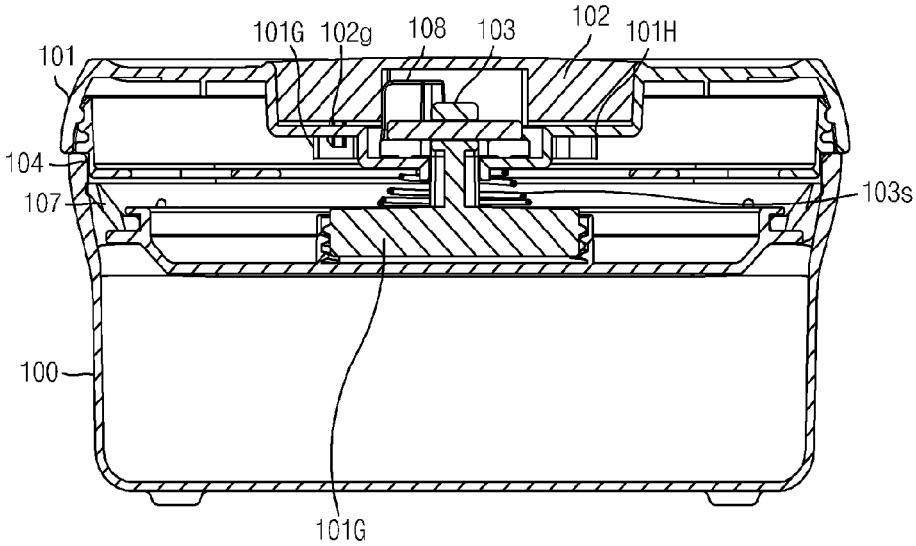
FIG. 3*b* is a sectional view showing the preservation container according to the preferred embodiment of the present invention.
Figure 4:
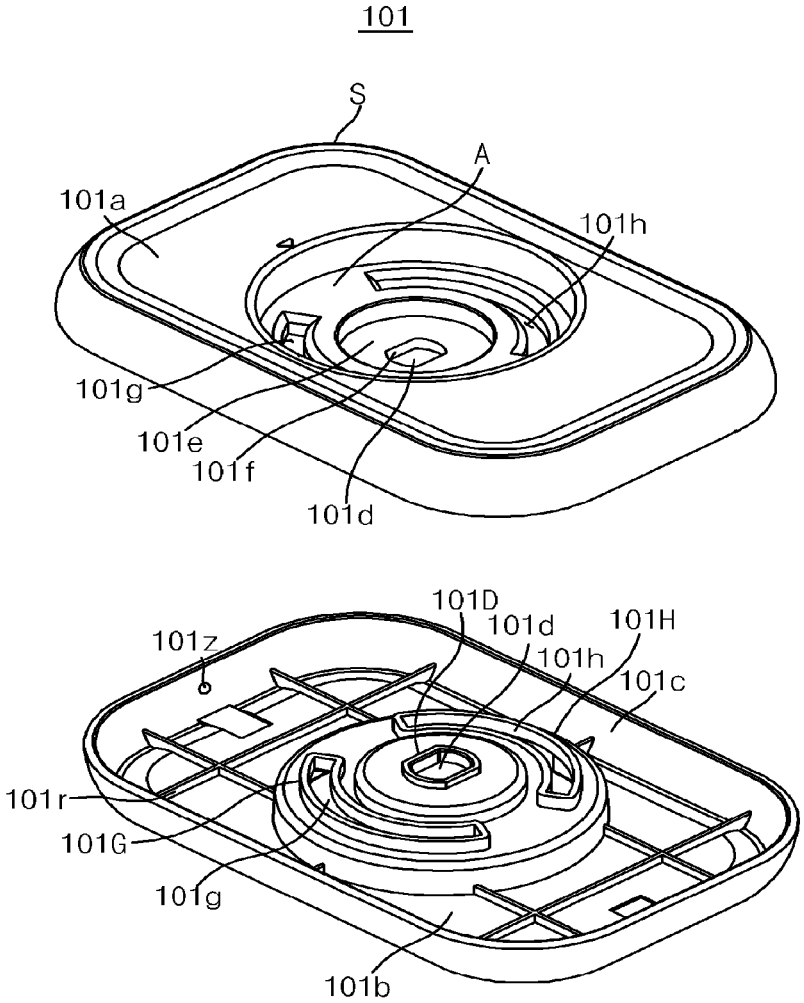
FIG. 4 is a perspective view showing a top and a bottom of an upper cover according to the preferred embodiment of the present invention.
Figure 5:
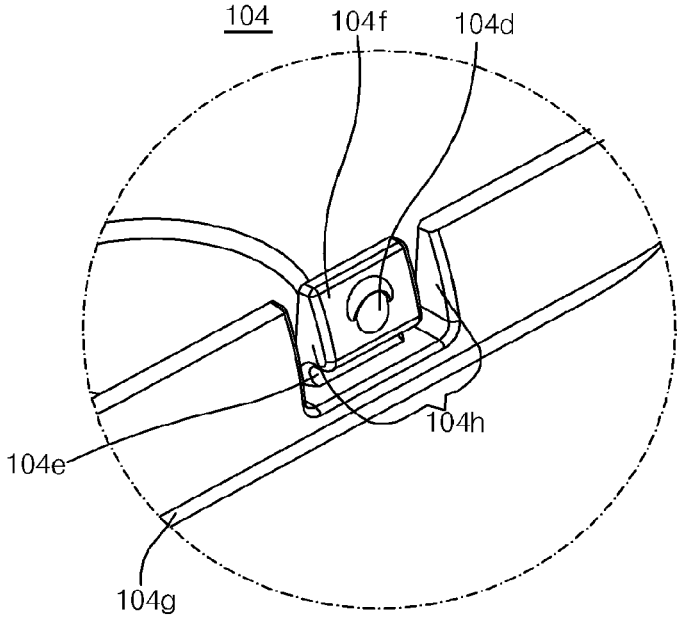
FIG. 5 is an enlarged view showing a portion of an intermediate cover according to the preferred embodiment of the present invention.
Figure 6:
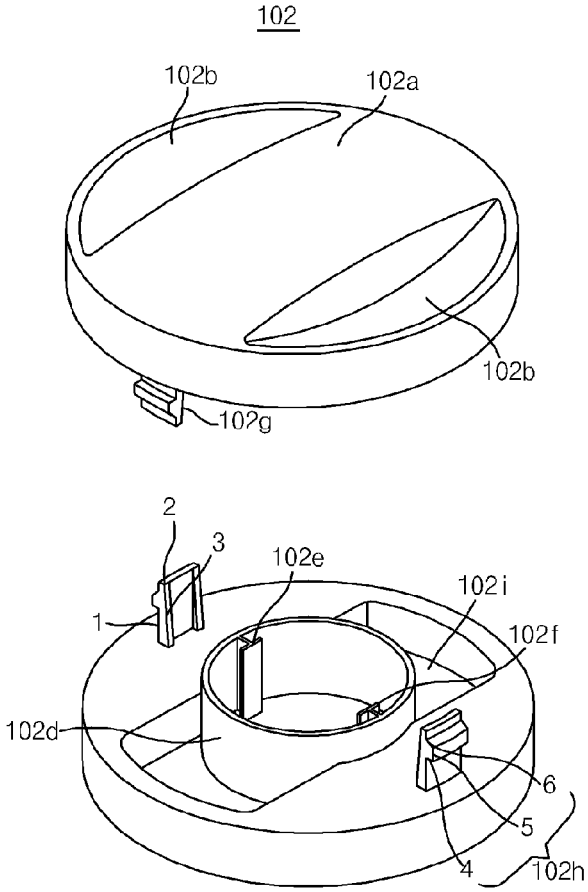
FIG. 6 is a perspective view showing a top and a bottom of the knob according to the preferred embodiment of the present invention.

Hereinafter, the preferred embodiment of the present invention will be described with reference to the accompanying drawings. A detailed description of components common to both the prior art and the present invention will be omitted herein, because those skilled in the art may understand such common components from the prior art.

For ease of description, both sides of a preservation container in an axial direction thereof will be referred to as upper and lower sides, while both sides of the preservation container in a lateral direction thereof will be referred to as left and right sides.

According to the present invention, a preservation container 500 includes a container body 100 and a lid assembly 200 which is detachably coupled to the top of the container body 100. The lid assembly 200 includes an upper cover 101, a knob 102, a vertical moving unit 103, an intermediate cover 104, a lower cover 105, and a packing 107. The knob 102 is provided on a top 101*a* of the upper cover 101, and is rotated by a user. The vertical moving unit 103 is coupled to the upper cover 101, and is moved up and down by the rotation of the knob 102. The intermediate cover 104 is detachably coupled to a bottom 101*b* of the upper cover 101, and has in its central portion a hole 104H through which the vertical moving unit 103 is exposed to the outside. The lower cover 105 is coupled to the vertical moving unit 103. The packing 107 is fitted into a groove which is formed in a top 105*e* of the lower cover 105, and slides along a bottom 104*b* of the intermediate cover 104 to be in close contact with an inner surface of the container body 100, when the vertical moving unit 103 moves up.

Further, the preservation container 500 of the present invention includes a bottom plate 101*e* having an insert hole 101*d* in a central portion of the top 101*a* of the upper cover 101. The vertical moving unit 103 is inserted into the insert hole 101*d*. A first wall 101*f* is formed to be perpendicular to the bottom plate 101*e*. First and second holes 101*g* and 101*h* are circumferentially formed on opposite sides of the upper end of the first wall 101*f*. An auxiliary member 108 is mounted on the bottom plate 101*e*, with a hole being formed in a central portion of the auxiliary member 108. An inclined surface 108*a* is formed on an upper portion of the auxiliary member 108. First and second protrusions 108*b* and 108*c* are connected to the inclined surface 108*a* in such a way as to be perpendicular thereto. A recess 108*h* is formed on an outer surface of each of the first and second protrusions 108*b* and 108*c*. Lugs 102*a* project from the bottom of the knob 102 to be inserted into the first and second holes 101*g* and 101*h*, respectively. A locking step 102*h* is provided on the inner or outer surface of each lug 102*a*. A cylinder 102*d* is provided on the central portion of the bottom of the knob 102. Third and fourth protrusions 102*e* and 102*f* are formed on an inner wall of the cylinder 102*d*. A pin 103*p* is horizontally inserted into a hole of the vertical moving unit 103. A spring 103*s* is fitted over the vertical moving unit 103 in such a way as to be in contact with the bottom 101*b* of the upper cover 101. A disc 105*a* is provided on the central portion of the lower cover 105. A second wall 105*b* is formed to be perpendicular to the disc 105*a*, with a threaded part being formed on an inner surface of the second wall 105*b*. The container body 100 is coupled to a lower end of the lower cover 105, and has on an inner surface thereof a groove 106 into which the packing 107 is inserted. When the knob 102 is turned clockwise, the pin 103*p* moves up along the inclined surface 108*a*, so that the spring 103*s* is compressed and simultaneously the vertical moving unit 103 is moved up. Thereby, the container body 100 is sealed. In contrast, when the knob 102 is turned counterclockwise, the pin 103*p* moves down along the inclined surface 108*a*, so that an elastic force of the spring 103*s* is restored and simultaneously the vertical moving unit 103 is moved down. Thereby, the sealing of the container body 100 is released.

In the preservation container 500 according to the present invention, the vertical moving unit 103 includes a base 103*a* which has a threaded part. A column 103*b* protrudes from a central portion of a top of the base 103*a*, and has a third hole 103*h*. A fifth protrusion 103*c* and a sixth protrusion 103*d* are provided on opposite sides of the top of the base 103*a*. Further, the lower cover 105 includes first stoppers 105*c* provided on an outer wall of the second wall 105*b*, and second stoppers 105*d* provided on an upper end of the second wall 105*b*. Thus, when the vertical moving unit 103 is coupled to the disc 105*a* of the lower cover 105, the fifth and sixth protrusions 103*c* and 103*d* move up along the first stoppers 105*c*, and are stopped by the second stoppers 105*d*.

The preservation container 500 of the present invention includes the container body 100, and the lid assembly 200 which is detachably coupled to the upper end of the container body 100.

The container body 100 is a storage part which is open at a top and holds food or the like therein. The container body 100 is coupled to the lower end of the lower cover 105, and has the groove 106 at an upper position on the inner surface thereof so that the packing 107 which will be described below in detail is inserted into the groove 106.

The groove 106 is located at the upper position on the inner surface of the container body 100, and has a curved shape to allow the packing 107 to be inserted into the groove 106. When the preservation container 500 is sealed, a portion of an edge of the packing 107 is inserted into the groove 106 and makes close contact with the groove 106. The groove 106 prevents the packing 107 from being unexpectedly removed therefrom by an external force. Since the packing 107 is inserted into the groove 106, the unexpected removal of the lid assembly 200 from the container body 100 can be prevented.

The upper cover 101 has the shape of a rectangular plate, and includes the top 101*a*, the bottom 101*b*, and an inner wall 101*c* which is inclined relative to the top 101*a* and extends towards the bottom 101*b*.

A plurality of curved portions S is formed on four corners of the upper cover 101.

Preferably, a space A is formed in the central portion of the top 101*a* of the upper cover 101 to receive the knob 102. The bottom plate 101*e* having the insert hole 101*d* is provided on the central portion of the top 101*a* of the upper cover 101.

The auxiliary member 108 which will be described below in detail is inserted into the bottom plate 101*e*.

A projecting part 101D extends towards the bottom 101*b* while surrounding the insert hole 101*d*. Upper and lower sides of the projecting part 101D have the shape of a straight line and are spaced apart from each other, while left and right sides of the projecting part 101*d* have a curved shape. The vertical moving unit 103 which will be described below is inserted into the insert hole 101*d* surrounded by the projecting part 101D.

The projecting part 101D is shaped to prevent the rotation of the vertical moving unit 103 and to permit only the vertical movement thereof.

Each of the space A and the bottom plate 101*e* has a circular shape.

The first wall 101*f* is formed on the bottom plate 101*e* to be perpendicular thereto.

The first and second holes 101*g* and 101*h* are circumferentially formed on opposite ends of the upper end of the first wall 101*f*.

Preferably, the space A includes the bottom plate 101*e*, the first hole 101*g*, and the second hole 101*h*, and protrudes towards the bottom 101*b*.

Guide rails 101G and 101H are circumferentially formed to surround the first and second holes 101*g* and 101*h*, respectively. The locking steps 102*h* of the lugs 102*g* of the knob 102 which will be described below in detail are caught by the inner surfaces of the guide rails 101G and 101H.

The inner wall 101*c* has the shape of a skirt, and defines the space A therein. Reinforcing ribs 101*r* are provided around the space A in such a way as to extend in the longitudinal and transverse directions of the inner wall 101*c*. The reinforcing ribs 101*r* include a plurality of vertical portions. Protrusions 101*z* are provided on the centers of the upper and lower ends of the inner wall 101*c*.

The protrusions 101*z* are inserted into protrusion insert holes 104*d* of the intermediate cover 104, which will be described below in detail.

The intermediate cover 104 is detachably coupled to the bottom 101*b* of the upper cover 101 in such a way as to face the bottom 101*b*.

The intermediate cover 104 includes a top 104*a*, the bottom 104*b*, and a wall 104*c* which is formed along an edge of the top 104*a*, has the same size as the top 101*a*, and is inclined, with an edge 104*g* being formed along a junction between the top 104*a* and the wall 104*c*.

Concave portions 104*e* are formed in the central portions of upper and lower ends of the wall 104*c*, and insert portions 104*f* having the protrusion insert holes 104*d* are formed, respectively, in the concave portions 104*e*. A hole 104*h* is formed to extend from each of opposite ends of each concave portion 104*e* to an end of the top 104*a*.

As the protrusions 101*z* are inserted into the corresponding protrusion insert holes 104*d*, the intermediate cover 104 is coupled to the bottom 101*b* of the upper cover 101.

A plurality of holes is formed in the top of the intermediate cover 104. The hole 104H formed in the central portion of the intermediate cover 104 allows the vertical moving unit 103 to be exposed to the outside. Holes 104*h* formed in upper and lower positions with respect to the hole 104H allow a user to insert his or her fingers into the holes 104*h* and to thus separate the intermediate cover 104 from the container 500.

The knob 102 is coupled to the space A of the upper cover 101.

The knob 102 has a circular shape. The knob 102 includes a finger grip 102*a* which protrudes from the central portion of the top of the knob 102, and semi-circular spaces 102*b* which are formed on opposite sides of the finger grip 102*a*. The spaces 102*b* are formed to allow a user to hold the finger grip 102*a*. It is preferable that the spaces 102*b* have a predetermined depth.

The cylinder 102*d* protrudes from the central portion of the bottom of the knob 102.

Cavities 102*i* are deeply formed in upper and lower portions with respect to the cylinder 102*d*.

Third and fourth protrusions 102*e* and 102*f* are formed on the inner wall of the cylinder 102*d*. Each of the third and fourth protrusions 102*e* and 102*f* is inclined downwards to the left side with respect to a vertical direction of the cylinder 102*d*. That is, it is preferable that each of the third and fourth protrusions 102*e* and 102*f* be installed at an angle of about 135 degrees. Each of the third and fourth protrusions 102*e* and protrusion 102*f* includes a vertical portion and a horizontal portion. The vertical portion is attached to the inner surface of the cylinder 102*d*.

The lugs 102*g* are provided on the bottom of the knob 102, and are inserted into the first and second holes 101*g* and 101*h*. A plurality of lugs 102*g* is preferably provided in the same direction as the third and fourth protrusions 102*e* and 102*f*.

Each lug 102*g* includes a vertical portion 1 which is placed in a vertical direction relative to the knob 102, a horizontal portion 2 which is placed in a horizontal direction relative to the knob 102, and an inclined portion 3 which is inclined relative to the horizontal portion 2. The lug 102*g* protrudes from the knob 102. It is preferable that the thickness of the lug 102*g* be reduced in a direction from an upper end to a lower end thereof.

The locking step 102*h* is provided on the outer surface of the lug 102*g*. The locking step 102*h* is inserted into and stopped by each of the first and second holes 101*g* and 101*h*. The locking step 102*h* includes a horizontal portion 4, a vertical portion 5 which is perpendicular to the horizontal portion 4, and an inclined portion 6 which is inclined relative to the vertical portion 5.

As the knob 102 is turned, the vertical portion 1 is rotated while engaging with each of the first and second holes 101*g* and 101*h*. The knob 102 is constructed to be rotated within the angular range of 90 degrees. The knob 102 is constructed so that its lugs 102*a* are detached from the first and second holes 101*g* and 101*h*.

The auxiliary member 108, having in the central portion thereof a circular hole 108*d*, is mounted on the central portion of the bottom plate 101*e*. The vertical moving unit 103 which will be described below in detail is inserted into the hole 108*d* of the auxiliary member 108.

The inclined surface 108*a* is formed on the upper portion of the auxiliary member 108 in such a way as to be inclined at a predetermined angle. The first and second protrusions 108*b* and 108*c* are perpendicularly connected to the inclined surface 108*a* in such a way as to protrude therefrom and to be symmetrical with respect to each other.

The inclined surface 108*a* is formed between the first and second protrusions 108*b* and 108*c*. The inclined surface 108*a* extends from a lower position to an upper position, and is sharply inclined at an end of the inclined surface 108*a*.

The first and second protrusions 108*b* and 108*c* are symmetrically formed on opposite sides of the hole 108*d*. The third and fourth protrusions 102*e* and 102*f* are inserted into the first and second protrusions 108*b* and 108*c*.

Each of the first and second protrusions 108*b* and 108*c* includes an arc-shaped portion 7 which is formed along part of a circumference of the hole 108*d*, straight-line portions 8 which are obliquely provided on opposite sides of the arc-shaped portion 7, and curved portions 9 which are obliquely extending from side edges of the corresponding straight-line portions 8. The recess 108*h* is formed in the outer surface of each of the first and second protrusions 108*b* and 108*c*. The recess 108*h* has a rectangular cross-section and curved corners. The recess 108*h* is formed through a bottom of the auxiliary member 108.

The vertical moving unit 103 is inserted into the insert hole 101*d* and the hole 108*d* when it is installed. The vertical moving unit 103 includes the circular base 103*a* having a threaded part 103*j*, the column 103*b* which protrudes from the central portion of the top of the base 103*a* and has the third hole 103*h*, and the fifth and sixth protrusions 103*c* and 103*d* which are provided on opposite sides of the top of the base 103*a*. Further, the vertical moving unit 103 includes the pin 103*p* inserted into the third hole 103*h*, and the spring 103*s* which is fitted over the column 103*b* and installed to be in contact with the bottom 101*b* of the upper cover 101.

The column 103*b* protrudes in the form of a pillar, and the top of the column 103*b* has the same shape as the projecting part 101D. Thus, the column 103*b* does not perform a rotation but performs only a vertical movement. The third hole 103*h* is formed in the upper portion of the column 103*b* in such a way as to pass therethrough in a direction from a front to a back. A recess is formed under the third hole 103*h*, and has the shape of a rectangle that has four curved corners.

Each of the fifth and sixth protrusions 103*c* and 103*d* has a horizontal portion 103*g* which is provided on each of the opposite sides of the base 103*a* and has curved corners, and a projecting part 103*i* which is connected to the horizontal portion 103*g* and projects towards the bottom of the base 103*a*.

Preferably, the threaded part 103*j* is formed on a portion of the base 103*a*, except for portions of the base 103*a* located under the fifth and sixth protrusions 103*c* and 103*d*.

Further, a cross-shaped rib 103*e* is formed on the bottom of the base 103*a*.

The pin 103*p* is inserted into a lower portion of the inclined surface 108*a* of the auxiliary member 102, and is stopped by the first or second protrusion 108*b* or 108*c*.

The spring 103*s* comprises a coil spring.

Figure 7A:
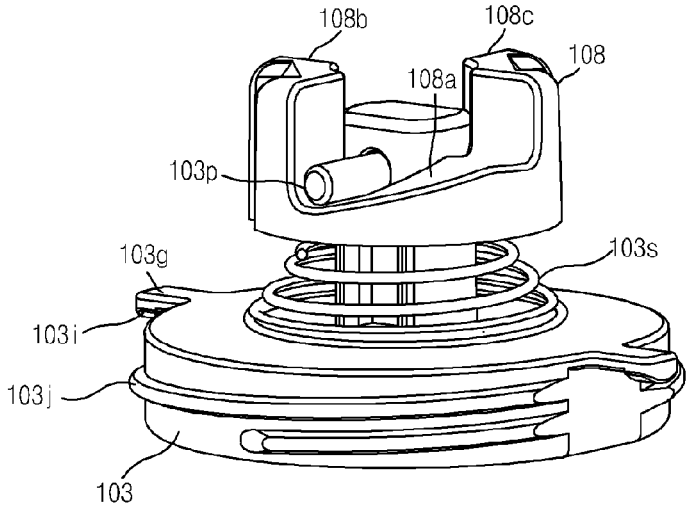
FIG. 7*a* is a perspective view showing a vertical moving unit and an auxiliary member which are assembled with each other, according to the preferred embodiment of the present invention.

As shown in FIG. 7*a*, the spring 103*s* functions to prevent the pin 103*p* from being removed from the auxiliary member 102, in addition to preventing the auxiliary member 102 from moving.

Figure 7B:
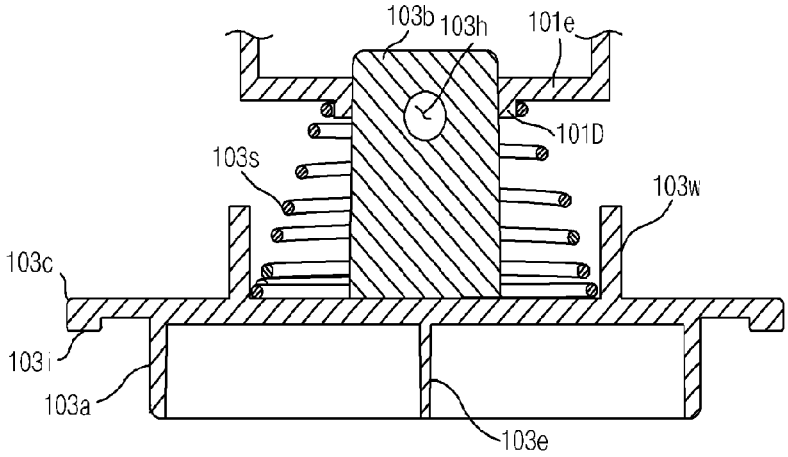
FIG. 7*b* is a sectional view showing a vertical moving unit another embodiment of the present invention, in which the vertical moving unit has protrusions on opposite sides of a spring.
Figure 8:
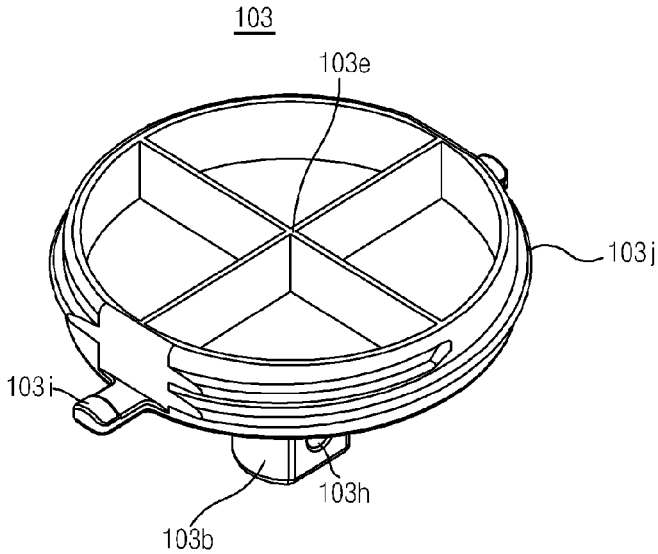
FIG. 8 is a bottom perspective view showing the vertical moving unit according to the preferred embodiment of the present invention.
Figure 9:
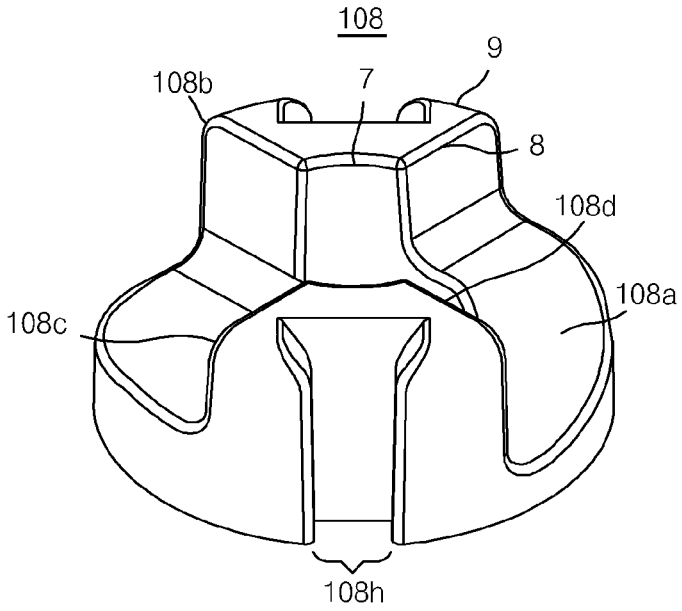
FIG. 9 is a perspective view showing the auxiliary member according to the preferred embodiment of the present invention.
Figure 10:
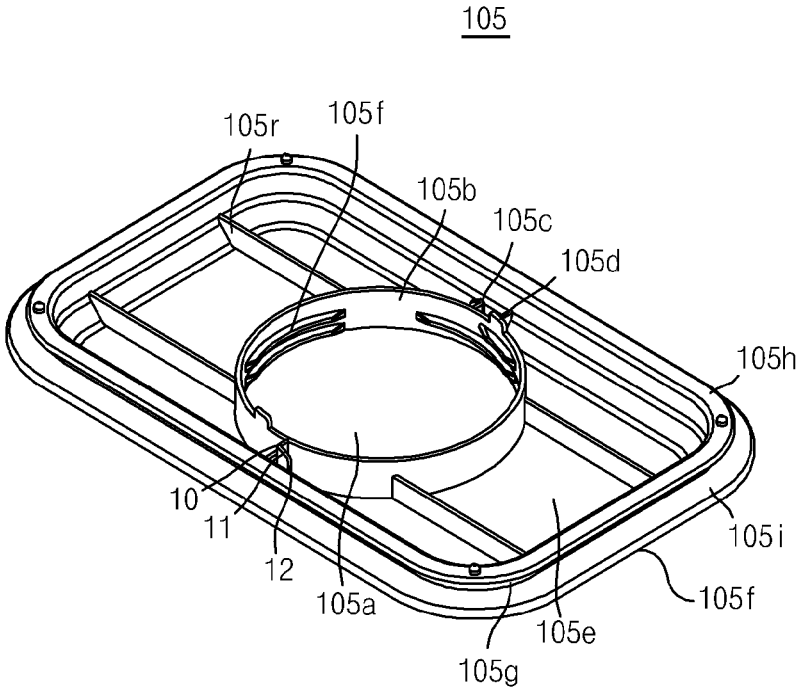
FIG. 10 is a top perspective view showing a lower cover according to the preferred embodiment of the present invention.

According to another embodiment, as shown in FIG. 7*b*, protrusions 103*w* for supporting the spring 103*s* may be provided on the top of the base 103*a* in such a way as to be placed on the left and right sides of the spring 103*s*.

When the knob 102 is turned at 90 degrees clockwise, the pin 103*p* moves up along the inclined surface 108*a*, so that the spring 103*s* is compressed, and simultaneously the vertical moving unit 103 is moved up, and thus the container body 100 is sealed. In contrast, when the knob 102 is turned counterclockwise, the pin 103*p* moves down along the inclined surface 108*a*, so that the elastic force of the spring 103*s* is restored, and simultaneously the vertical moving unit 103 is moved down, and thus the sealing of the container body 100 is released.

The lower cover 105 includes the top 105*e*, a first wall 105*f*, a first rim 105*i*, a second wall 105*g*, and a second rim 105*h*. The first wall 105*f* is inclined relative to the top 105*e*. The first rim 105*i* extends horizontally from an upper end of the first wall 105*f*. The second wall 105*g* is formed perpendicular to the first rim 105*i*. The second rim 105*h* extends horizontally from an upper end of the second wall 105*g*.

The packing 107 is inserted between a top of the first rim 105*i* and a bottom of the second rim 105*h*.

As the knob 102 is turned to seal the container body 100, the vertical moving unit 103 is moved up, and the packing 107 is in close contact with the inner surface of the container body 100 while sliding along the bottom of the intermediate cover 104. The packing 107 may be made of silicone or rubber.

The lower cover 105 also includes the disc 105*a*, the second wall 105*b*, the first stoppers 105*c*, and the second stoppers 105*d*. The disc 105*a* is provided on the central portion of the lower cover 105. The second wall 105*b* has on its inner surface the threaded part. The first stoppers 105*c* are provided on the outer surface of the second wall 105*b*. The second stoppers 105*d* are provided on the upper end of the second wall 105*b*. The second wall 105*b* is coupled to the base 103*a* of the vertical moving unit 103.

The disc 105*a* has a circular shape and is fixed. A reinforcing rib 105*r* is formed on the top, bottom, left, and right of the disc 105*a*. The reinforcing rib 105*r* includes a plurality of vertical portions and horizontal portions.

The first stopper 105*c* includes a first horizontal portion 10 which is formed horizontally relative to the disc 105*a*, a second horizontal portion 11 which is inclined relative to the first horizontal portion 10, and an inclined portion 12 which is inclined relative to the second horizontal portion 11. It is preferable that the first horizontal portion 10, the second horizontal portion 11, and the inclined portion 12 extend to the top 105*e* of the lower cover 105.

The second stopper 105*d* has a rectangular shape, and is perpendicular to the disc 105*a*.

When the disc 105*a* is coupled to the bottom of the vertical moving unit 103, the fifth and sixth protrusions 103*c* and 103*d* move up along the first stoppers 105*c*, and then are stopped by the second stoppers 105*d*. The first stopper 105*c* controls a rotating direction to prevent the base 103*a* from being turned any more, while the second stopper 105*d* provides play so as to prevent movement and shaking.

As described above, the present invention provides a preservation container, in which the container may be easily sealed by turning a knob of a lid assembly clockwise, and the sealing of the container may be released by turning the knob counterclockwise.

Further, the present invention provides a preservation container, which allows sealing and releasing operations to be easily performed without a large amount of force, and which is constructed so that parts of the container may be disassembled from each other, thus making it easy to clean the interior of the container.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A preservation container having a container body and a lid assembly which is detachably coupled to a top of the container body, wherein the lid assembly comprises:

an upper cover;

a knob provided on a top of the upper cover, and rotated by a user;

a vertical moving unit coupled to the upper cover, and moved up and down by a rotation of the knob;

an intermediate cover detachably coupled to a bottom of the upper cover, and having in a central portion thereof a hole through which the vertical moving unit is exposed to an outside;

a lower cover coupled to the vertical moving unit;

a packing fitted into a groove which is formed in a top of the lower cover, and sliding along a bottom of the intermediate cover to be in close contact with an inner surface of the container body, when the vertical moving unit moves up;

a bottom plate having an insert hole in a central portion of the top of the upper cover, with the vertical moving unit being inserted into the insert hole;

a first wall formed to be perpendicular to the bottom plate;

first and second holes circumferentially formed on opposite sides of an upper end of the first wall;

an auxiliary member mounted on a top of the bottom plate, with a hole being formed in a central portion of the auxiliary member;

an inclined surface formed on an upper portion of the auxiliary member;

first and second protrusions connected to the inclined surface in such a way as to be perpendicular thereto;

a recess formed on an outer surface of each of the first and second protrusions;

lugs projected from a bottom of the knob to be inserted into the first and second holes, respectively;

a locking step provided on an inner or outer surface of each of the lugs;

a cylinder provided on a central portion of the bottom of the knob;

third and fourth protrusions formed on an inner wall of the cylinder;

a pin horizontally inserted into a hole of the vertical moving unit;

a spring fitted over the vertical moving unit in such a way as to be in contact with the bottom of the upper cover;

a disc provided on a central portion of the lower cover; and a second wall formed to be perpendicular to the disc, with a threaded part being formed on an inner surface of the second wall, and the container body is coupled to a lower end of the lower cover, and has on an inner surface thereof a groove into which the packing is inserted, whereby, when the knob is turned clockwise, the pin moves up along the inclined surface, so that the spring is compressed and simultaneously the vertical moving unit is moved up, thereby sealing the container body, and when the knob is turned counterclockwise, the pin moves down along the inclined surface, so that an elastic force of the spring is restored and simultaneously the vertical moving unit is moved down, thereby releasing a sealing of the container body.

2. The preservation container as set forth in claim 1, wherein the vertical moving unit comprises:

a base having a threaded part;

a column protruding from a central portion of a top of the base, and having a third hole; and fifth and sixth protrusions provided on opposite sides of the top of the base, and the lower cover comprises:

a first stopper provided on an outer surface of the second wall; and a second stopper provided on an upper end of the second wall, whereby, when the vertical moving unit is coupled to the disc, each of the fifth and sixth protrusions moves up along the first stopper and is stopped by the second stopper.

* * * * *